United States Patent [19]

Stein et al.

[11] Patent Number: 4,825,775

[45] Date of Patent: May 2, 1989

[54] RAILCAR TRUCK BOLSTER WITH PREASSEMBLED FRICTION SHOES

[75] Inventors: Eugene S. Stein, Lansing; Charles N. Hood, II, Deerfield; Charles P. Spencer, Staunton, all of Ill.

[73] Assignee: AMSTED Industries Incorporated, Chicago, Ill.

[21] Appl. No.: 39,944

[22] Filed: Apr. 20, 1987

[51] Int. Cl.[4] ..... B61F 5/24; B61F 5/50

[52] U.S. Cl. ..... 105/198.5; 105/207

[58] Field of Search ..... 105/198.5, 198.2, 207

[56] References Cited

U.S. PATENT DOCUMENTS

| | | | |
|---|---|---|---|
| 2,615,403 | 10/1952 | Orr et al. | 105/198.5 X |
| 2,650,550 | 9/1953 | Pierce | 105/198.5 |
| 2,720,172 | 10/1955 | Baselt | 105/198.5 |
| 2,953,995 | 9/1960 | Baker | 105/198.2 |
| 2,972,967 | 2/1961 | Bachman et al. | 105/198.5 |
| 3,855,942 | 12/1974 | Mulcahy | 105/207 X |

*Primary Examiner*—Johnny D. Cherry
*Assistant Examiner*—Joseph D. Pape
*Attorney, Agent, or Firm*—Charles E. Bouton; Edward J. Brosius

[57] ABSTRACT

Friction shoes are preassembled in each end of a railcar truck bolster by providing openings in the bolster and in the shoes and passing a restraining member through the openings at each bolster end and tensioning and securing the restraining members so as to hold the shoes within respective pockets in the bolster. The shoes and pockets are further provided with cooperating anti-ejection features to prevent ejection of shoes after installation.

6 Claims, 2 Drawing Sheets

RAILCAR TRUCK BOLSTER WITH PREASSEMBLED FRICTION SHOES

BACKGROUND OF THE INVENTION

This invention relates to railcar trucks and more particularly involves a method for preassembling a bolster with friction shoes fitted therein, the improved assembly of a bolster with friction shoes and improved bolster and shoe components therefore.

A typical railcar truck comprises wheelsets mounted on two axles which support side frames at each side of the railcar and a transverse bolster extending between the side frames with the ends thereof supported on load springs carried by each side frame between two vertical friction plates. Usually a truck is located under each end of a railcar and the car itself is pivotally supported upon a centerplate centrally positioned on each bolster. Thus the weight of the railcar will cause the ends of the bolsters to move vertically on the load springs while confined between the friction plates.

To provide proper damping for the suspension system, friction shoes are located in pockets to each side of the bolster adjacent the side frame friction plates. The friction shoes have vertically disposed friction faces which contact the friction plate. In certain types of such friction shoes there is a shoe slope surface, generally opposite the friction face, which declines from a top portion of the friction shoe to a bottom portion thereof and away from the friction face and which engages a bolster slope surface on the inside of the pocket. The latter type shoe also has a bottom opening or hole through which a control spring extends from the bolster to the top portion of the shoe. The control spring urges the friction shoe against the bolster slope and upwardly through the pocket, while the slope also guides the shoe outwardly against the vertical friction plate.

THE PRIOR ART

When a truck is assembled the shoes, and control springs, are normally first placed in the bolster pockets at the assembly site and thereafter the bolster ends are inserted through each respective side frame. The load springs are then positioned in each side frame and the bolster ends lowered thereon. Normally it is necessary to temporarily compress and secure each of the shoes fully within the respective bolster pockets so that the bolster ends may be inserted between the side frame friction plates. In the past this has been done by inserting pins through holes in the internal pocket walls into corresponding holes in the shoes. Such pins are, with difficulty, manually manipulated through inspection openings in the bolster walls; and must be similarly removed after the truck is assembled.

It has been proposed that the shoes could be compressed and held in place by a full exterior encirclement fastened about the outer periphery of the bolster and shoes and which could be easily released. However this is not practical as such an encirclement interferes with proper bolster side wall placement between the side frame vertical friction plates. Moreover such a full exterior encirclement, when released, is immediately gripped between the friction shoe friction face and the side frame friction plates where it will interfere with proper movement of the parts. Accordingly, an easily releaseable preassembled bolster with pre-compressed friction shoes without sideward interference would be of significant benefit to the railroad industry. Moreover such pre-assembly could be most expeditiously undertaken at a bolster manufacturing facility rather than at a truck or railcar assembly point.

SUMMARY OF THE INVENTION

Accordingly, it is a primary object of the present invention to provide a method for pre-assembling a railcar truck bolster with friction shoes releasably held compressed within bolster pockets by means of restraining members that do not extend to the sides of the bolster, but which may be easily released from outside the bolster.

It is another object of the present invention to provide a railroad truck bolster preassembled with friction shoes which are releasably held compressed within the bolster pockets by means of restraining members that do not extend to the sides of the bolster but which may be easily released from outside the bolster.

A further object of the present invention is to provide an improved railcar truck bolster having means within the bolster pockets to receive a restraining member that does not extend outside the bolster side walls.

Still another object of the present invention is to provide an improved railcar bolster friction shoe having means to receive a restraining member by which it may be releasably held compressed within a bolster pocket.

Yet another object of the present invention is to provide improved railcar truck bolster and friction shoe structures which inhibit ejection of the shoe from a bolster pocket.

In brief the present invention comprises the application at each end of a bolster of a restraining member, such as a narrow strap, which extends through openings in the walls defining two opposite pockets at one end of a bolster upwardly through each friction shoe placed therein and through openings in the top portions of those friction shoes. Preferably the restraining member is a partial encirclement that extends across the exterior surface of the bolster top wall between two opposite shoes.

DESCRIPTION OF THE DRAWINGS

Further objects and advantages of the present invention will become apparent from the following detailed description of a preferred embodiment in conjunction with the drawings therein.

DETAILED DESCRIPTION OF THE INVENTION

Figure 1:
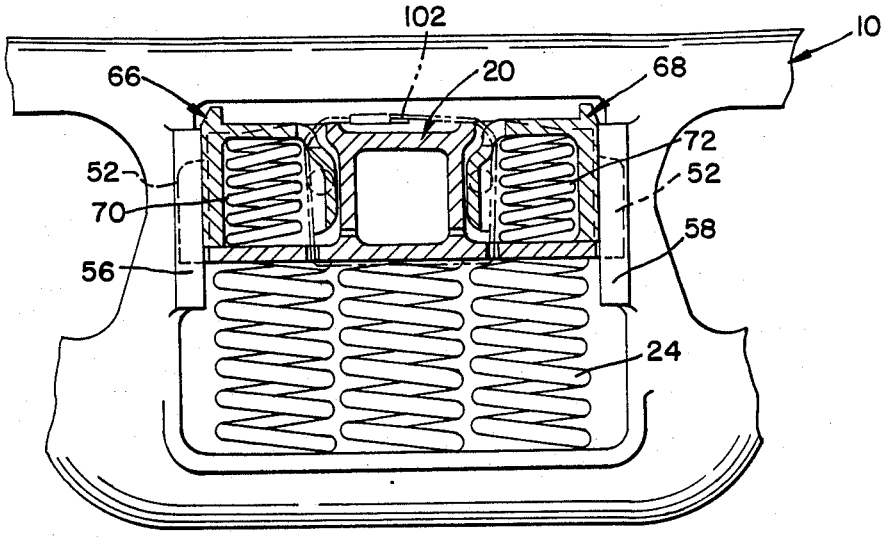
FIG. 1 is an elevation view of a partially assembled railcar truck with bolster end supported in a side frame, the bolster end being shown in section.
Figure 2:
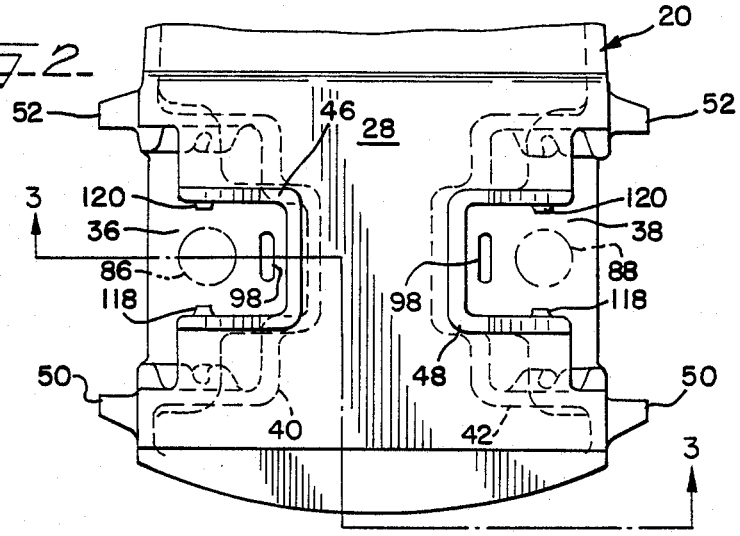
FIG. 2 is a detail plan view of a bolster end in accordance with a preferred embodiment of the present invention.

Existing railcar structures employ trucks comprising side frames generally 10 which are supported above bearings (not shown) resting on axles and wheels (also not shown). A transverse bolster generally 20 extends between two side frames 10 with each bolster end portion 22 supported on load springs 24 seated in the side frames 10. The bolster is usually an essentially hollow member of cast steel having a top wall 28, bottom wall 30 and two opposite side walls 32, 34. At each bolster end 22 there are two pockets generally 36, 38 formed by internal walls 40, 42, respectively, which extend to the bottom wall 30 from opposite openings in the side walls, 32, 34 and adjacent areas of the top wall 28. Usually raised lands 46, 48 partially surround the respective pocket 36, 38 openings in the bolster top wall 28; and vertical gibs 50, 52 are formed in each of the side walls 32, 34 onward of the pocket openings therein.

When assembled with the side frames 10, the bolster ends 22 are urged upward by the load springs 24 and are movable vertically between closely spaced friction plates 56, 58 that are vertically disposed in the side frames, with the gibs 50, 52 located at the outward and inward edges of the friction plates so as to prevent separation of the bolster 20 from the side frame 10. Friction shoes generally 66, 68 are reciprocally mounted on control springs 70, 72, respectively, within the respective pockets 36, 38 so as to be urged against the friction plates 56, 58.

Figure 3:
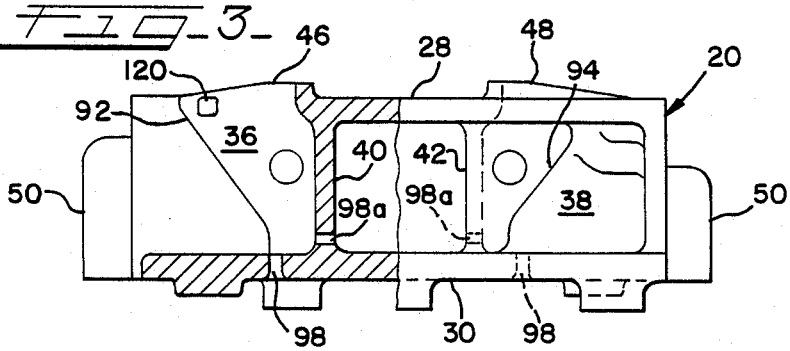
FIG. 3 is an end view of the bolster in partial section taken along line 3—3 in FIG. 2.
Figure 4:
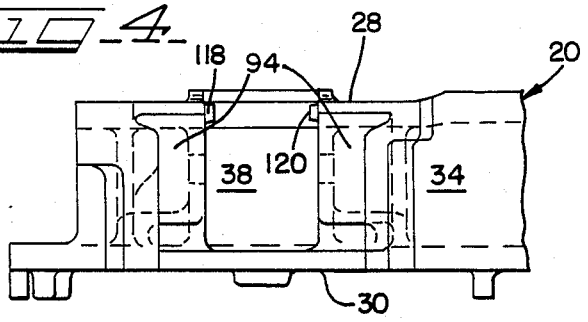
FIG. 4 is a side view of the bolster end of FIG. 2.
Figure 5:
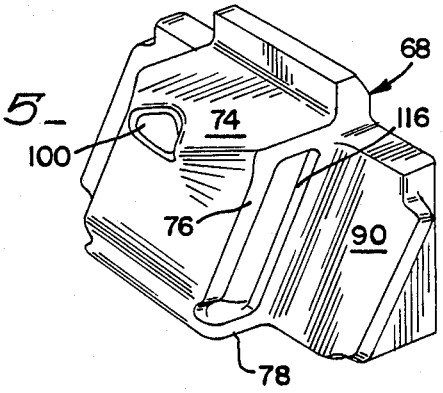
FIG. 5 is an isometric view of a friction shoe in accordance with the present invention.
Figure 6:
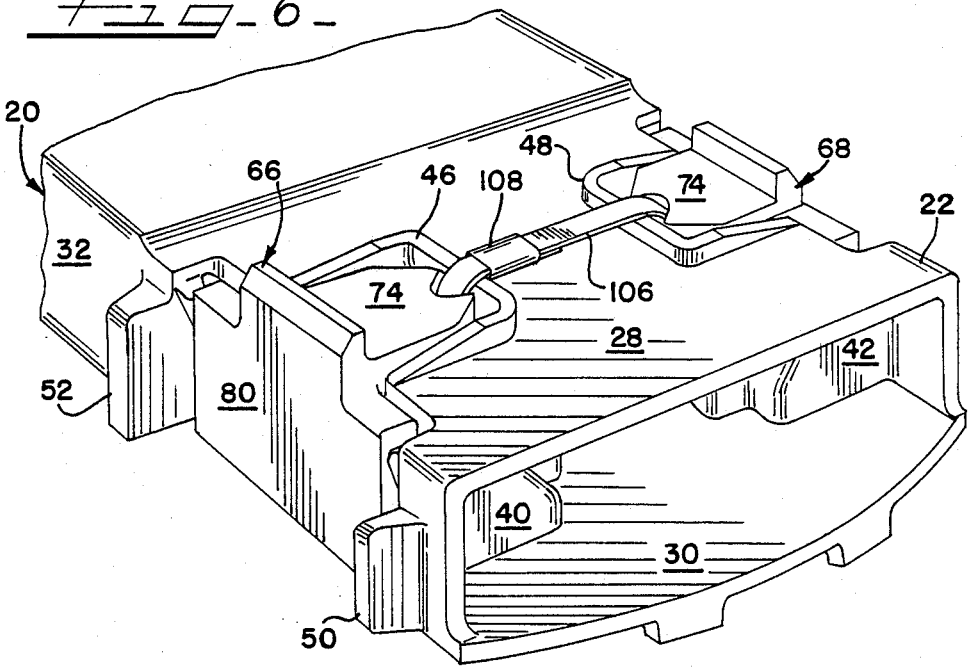
FIG. 6 is an isometric view of a bolster (end) with two friction shoes and partial encirclement preassembled in accordance with the present invention.

Each friction shoe 66, 68 comprises a hollow body having top portion 74, side portions 76, a bottom foot 78 and a vertical friction face 80, and is placed in its respective pocket with the friction face 80 disposed to engage a friction plate 56 or 58. As may be seen in FIG. 3, the respective control spring 70 or 72 extends upwardly through a hole in the foot 78 of a shoe, from a spring seat 86, 88 on the bolster bottom wall 30 within pockets 36, 38, and against the underside of the shoe top portion so as to urge the shoe out of the pocket.

Each shoe 66, 68 also has sloped surfaces 90 extending essentially between the levels of the top portion 74 and foot 78 and declining away from the friction face 80. The sloped surfaces 90 of shoes 66, 68 are positioned inwardly of the pockets 36, 38 so as to engage mating bolster slopes 92, 94 formed in the respective pocket internal walls 40, 42 so that the shoes are directed against the friction plates 56, 58.

According to the present invention the friction shoes 66, 68 may be preassembled and held fully compressed against control springs 70, 72 within the pockets 36, 38 of a bolster generally 20 by providing openings or slots 98 in one of the walls defining each pocket (either the bolster bottom wall 30 or an internal pocket wall 40, 42) and an opening or slot 100 in each shoe top portion 74, spaced away from the friction face, passing a restraining member 102 through the slots 98, 100, moving each shoe 66, 68 inwardly within the respective pocket to compress each control spring, tensioning the restraining member to hold the shoe compressed in the pocket and then securing or anchoring the restraining members while tensioned.

One way in which the foregoing method may be accomplished is to pass separate strands through each shoe and its respective pocket and anchor each end thereof (such as by knotting or applying fasteners) at the exterior of the respective openings in the shoe and pocket wall.

A preferred method for pre-assembling the shoes and bolster in the manner shown in the drawings is to pass a band 106 first through slots 98 in the pocket walls (either internal wall or bolster bottom) of two opposite pockets 36, 38 at one bolster end 22 and pull the band 106 so that equal lengths extend out of each pocket. Each such end is then threaded through the spring hole in the bottom foot 78 and the slot 100 in the top portion 74 of each respective shoe 66, 68 and each control spring 70, 72 is inserted in the respective shoe. Both shoes 66, 68 are then compressed within the respective pockets 36, 38 and the ends of band 106 are drawn up tightly toward one another and tensioned across the top wall 28 of the bolster 20 where the band ends are secured together, under tension, so as to hold the shoes compressed within the pockets. In the preferred embodiment the band 106 is made of steel and the ends are secured together by a metal clamp or clip 108 which is crimped thereon. The ends could also be riveted or welded together and there are other materials, such as plastics that may be suitable for the band.

It will be seen in the figures that the preferred embodiment of preassembled parts comprise a bolster generally 20 with friction shoes 66, 68 held compressed within pockets 36, 38 at each end 22 thereof by bands 106 which extend through the bolster 20 and shoes and are secured by clamps 108 exterior of the bolster top wall 28. Notably the bands 106 do not extend around the bolster side walls 32, 34 nor across the shoe friction faces 80. Thus the bands 106 are deemed to be partial encirclements of the bolster ends 22 and shoes 66, 68, because the bands 106 are closed upon themselves and extend around parts of each shoe and bolster end and outside of at least the top or bottom wall of the bolster end.

When preassembled in the aforedescribed manner, the bolster 20 may be shipped to the truck assembly site and there inserted in the lower areas of each side frame 10 and then lifted into position between the side frame friction plates 56, 58. Usually the bolster 20 will be held in this position, slightly lowered from the top travel limit, whereby the restraining members may be severed in the upwardly exposed area above the bolster top wall so as to free the shoes 66, 68 to move into contact with the friction plates 56, 58. In some instances the severed restraining members may simply be left in place. With the preferred embodiment it is advantageous to engage the clamp 108 with bifurcated fork and, after the band 106 is severed, the band is removed by winding it onto the fork.

Thereafter it is usual to insert the load springs beneath the bolster ends 22.

It may also be observed in the drawings that there are two alternatives to the aforedescribed preferred embodiment. According to one alternative the slots 98 in the bolster wall are located in the bottom wall 30 adjacent each control spring seat whence the band 106 will extend outward both above and below the bolster 20. In a second alternative the slots **98*a* are located in the internal pocket walls 40, 42, at the base of the innermost portions thereof also near the control spring seats, in which case the band 106 will extend outward of the bolster 20** only at the top.

A further improvement feature illustrated in the drawings is an anti-ejection means to prevent loss of one or both shoes 66, 68 should the restraining member (or band 106) be accidentally broken during shipment of a preassembled bolster. The anti-ejection means comprises inclined grooves 116 in the side portions 76 of each shoe 66, 68, which grooves 116 extend parallel with the shoe slope 90 and extend partially into the shoe portion opposite the friction face, and small lugs 118, 120 projecting inwardly from the bolster top wall 28 at each side of a pocket near a bolster side wall (e.g.

pocket 36 near side wall 32 and pocket 38 near side wall 34). When the respective shoe 66, 68 is inserted into its pocket 36, 38 the inclined grooves 116 are first fitted over the lugs 118, 120. Each groove then tracks on an interfitting lug; and the shoes cannot be removed from the bolster sideways except when lifted to the very top of the pocket. Thus each shoe will normally be retained at least partially in its pocket and will not be ejected therefrom after being inserted.

The foregoing detailed description has been given for clearness of understanding and to provide a complete description of a preferred embodiment of the invention. Various modifications may be made without departing from the spirit and scope of the invention which is defined in the following claims.

What is claimed is:

1. A method for preassembling friction shoes and control springs in the pockets of a railcar truck bolster, said method comprising:

providing first openings in the bolster walls forming each pocket at locations adjacent the point where the control springs are seated in said pocket;

providing second openings in the top portions of the friction shoes at locations thereon which will be positioned inwardly of the bolster sides;

passing an unsecured partial encirclement means through said first openings and through the pockets at opposite sides of one end of said bolster;

placing such shoes with control springs in said pockets with said partial encirclement means extending through the control spring opening and said second openings;

compressing said shoes against said control springs;

drawing said unsecured partial encirclement means taut across said bolster and joining the unsecured ends thereof so as to hold said shoes compressed against said control springs in said pockets.

2. An improved railcar truck bolster assembly preassembled with friction shoes and control springs secured within pockets in said bolster, said assembly comprising:

a bolster having two ends each with top, bottom and two side walls and pockets extending inwardly from the top and side walls, said pockets being defined by internal pocket walls;

friction shoes in each of said pockets, each of said shoes having a top portion and bottom portion and being supported on a control spring which extends upward from said bolster bottom wall through a spring hole in the shoe bottom portion to the underside of said top portion whereby to tend to move each said shoe from its respective pocket;

a shoe slot in the top portion of each friction shoe;

a bolster slot in one of the bolster bottom wall and internal pocket walls adjacent the location of each control spring;

and a single strap at each end of said bolster, each said strap extending through said bolster slots and through the spring holes and shoe slots of each shoe at each said end, and each said strap being secured across at least one of the top and bottom walls of said bolster so as to hold said shoes within said pockets compressed against said control springs.

3. The device of claim 2 wherein said bolster slots are located in the bolster bottom wall.

4. The device of claim 2 wherein said bolster slots are located in the internal pocket wall.

5. The device of claim 2 wherein the bolster and each shoe have interfitting anti-ejection means to prevent sideways loss of a shoe from a pocket.

6. The device of claim 5 wherein the anti-ejection means comprise grooves inclined along the side portions of said shoes and lugs extending from the bolster top wall at the pocket therein so as to interfit with said grooves.

* * * * *